US005117159A

United States Patent [19]

Tomii et al.

[11] Patent Number: 5,117,159

[45] Date of Patent: May 26, 1992

[54] FLAT PANEL TYPE DISPLAY AND METHOD FOR DRIVING THE DISPLAY

[75] Inventors: Kaoru Tomii, Isehara; Hiroshi Miyama, Yokohama; Yoshikazu Kawauchi, Kawasaki; Jun Nishida, Tokyo, all of Japan

[73] Assignee: Matsushita Electric Industrial Co., Ltd., Osaka, Japan

[21] Appl. No.: 431,413

[22] Filed: Nov. 3, 1989

[30] Foreign Application Priority Data

Nov. 4, 1988 [JP] Japan ..... 63-278701
Nov. 29, 1988 [JP] Japan ..... 63-301199

[51] Int. Cl.[5] ..... G09G 1/04; H01J 29/70
[52] U.S. Cl. ..... 315/366; 313/422
[58] Field of Search ..... 315/366; 313/422

[56] References Cited

U.S. PATENT DOCUMENTS 2,863,091 12/1958 Epstein et al. ..... 315/366
2,961,575 11/1960 Pohl ..... 315/366
3,723,786 3/1973 Charles .

FOREIGN PATENT DOCUMENTS 56-67154 6/1981 Japan .
56-76149 6/1981 Japan .
59-89093 5/1984 Japan .
60-109156 6/1985 Japan .
60-115134 6/1985 Japan .
8505491 12/1985 World Int. Prop. O. .

OTHER PUBLICATIONS

Electro-Optical System Design, vol. 14, No. 1, Jan. 1982, pp. 31-42, Chicago, Ill., U.S.; T. S. Credelle: "Large-screen flat-panel television: A guided-beam display" * p. 34, line 42ff; figure 2 *.

*Primary Examiner*—Gregory C. Issing
*Attorney, Agent, or Firm*—Lowe, Price, LeBlanc & Becker

[57] ABSTRACT

A flat panel type display provided with a screen, control electrodes divided in a horizontal direction of the screen, light emitting fluorescent material formed on the control electrodes, a mesh-like electrode, scanning electrodes each divided in a vertical direction of the screen and facing the mesh-like electrode, an electron source for generating electron beams in the horizontal direction of the screen and deflection unit for deflecting the beams in the vertical direction. The deflection unit is provided with a signal supply device for applying first and second voltage levels to each scanning electrode. The first voltage level is at a level similar to that applied to the control or mesh-like electrode. The second voltage level is substantially less than the first voltage level. The second voltage level is sequentially applied to each scanning electrode during a vertical scan, for a fixed time period at least as long as the time required for vertically scanning a distance in which a path of an electron reflected from a position of beam incidence with the fluorescent material becomes substantially parallel to the scanning electrodes. The time period between the start of each sequential application of the second voltage level to each successive scanning electrode is a predetermined amount which differs from the fixed time period of the second voltage level.

9 Claims, 7 Drawing Sheets

FLAT PANEL TYPE DISPLAY AND METHOD FOR DRIVING THE DISPLAY

BACKGROUND OF THE INVENTION

1. Field of the Invention

This invention generally relates to a device and method for displaying a picture and more particularly to a flat panel type color display for use in a color television receiving device, a display terminal of a computer system and so on.

2. Description of the Related Art

A typical example of a conventional image tube is disclosed in the Japanese Patent Application Provisional Publication No. 56-76149 Official Gazette. FIGS. 1(A) and (B) are a section and plan views of this image tube, respectively. As shown in these figures, this image tube is provided with a flat tube body 101 made of glass and so forth. On an inner surface 101*a* of this tube body 101, a plurality of stripe-like control electrodes 102 [$102_1$, $102_2$, $102_3$, . . . $102_n$], the number of which is equal to that of pixels in the horizontal direction thereof, are arranged in parallel with each other at a predetermined interval. Further, on each of the control electrodes 102, a fluorescent screen 104 composing a screen of the display is formed by coating the electrode with fluorescent material 103 suitable for a low velocity electron beam. Over the fluorescent screen 104, is arranged a mesh-like electrode 107 facing the fluorescent screen 104 at a predetermined interval. Further, on another inner surface 101*b* of the tube body 101 facing the fluorescent screen 104, is provided a main deflecting electrode 106 for deflecting a strip-like electron beam to the fluorescent screen 104 and making the electron beam scan the screen 104 in the vertical direction as indicated by an arrow C in FIG. 1(B).

This main deflecting electrode 106 is made of a transparent conductive film. On the other hand, at the right side of the fluorescent screen 104, as viewed in FIG. 1(A) (that is, in a bottom end in the longitudinal direction of each control electrode 102, as viewed in FIG. 1(B), is arranged a beam source 108 for emitting a strip-like low velocity electron beam 105. The beam source 108 is composed of a cathode 109 stretched in the horizontal direction from left to right as viewed in FIG. (B) and made of tungsten, an electrode 111, to which a voltage substantially equal to a voltage applied to the cathode 109 is applied, enclosing this cathode 109 and having a slit 110 also extending in the horizontal direction from left to right as viewed in this figure and an accelerating electrode 113, to which a positive constant voltage, having a narrow slit 112. Further, in front of the beam source 108, is arranged an auxiliary deflecting electrode 114 comprised of a pair of electrode plates 114A and 114B for deflecting the strip-like electron beam 105 in cooperation with the main deflecting electrode 106.

Next, an operation of the conventional device as above constructed will be described hereinafter.

First, a nonmodulated strip-like electron beam emitted from the beam source 108 in parallel with the fluorescent screen 104 is deflected by the auxiliary deflecting electrode 114 and the main deflecting electrode 106 and is further incident on the fluorescent screen 104, and the fluorescent screen 104 is scanned at a constant speed by varying the extent of the deflection of the electrode beam in the vertical direction indicated by the arrow C in FIG. 1(B).

On the other hand, a video signal of one horizontal scanning interval is simultaneously supplied to each control electrode 102. In this case, the video signal is sampled correspondingly to pixels positioned in the horizontal direction, that is, to the control electrodes 102, and each of the sampled signal is serially supplied to each corresponding control electrode 102. Thus, a video signal is fed to each control electrode every horizontal scanning interval. At that time the surface of a fluorescent layer 103 provided on the each control electrode 102 is irradiated with the strip-like electron beam 105, and parallel lines on the fluorescent screen 104 are serially excited by the scan of the strip-like electron beam 105 and emit light, thereby obtaining a desired image.

However, the conventional device as above constructed has drawbacks that if the resolution power thereof is increased by dividing each control electrode among pixels, with the picture displaying area, which is available for displaying a picture or image, unchanged. A pitch i.c., or interval between adjacent control electrodes becomes extremely small and a division width obtained by the division becomes narrower. In such case there there is a limitation on the withstand voltage applied between control electrodes. The voltage of the video signal applied to each control electrode cannot be sufficiently increased and consequently it becomes very difficult to obtain a light picture. To avoid such problem the number of video signal processing circuits should be equal to that of the control electrodes. Such provision increases power consumption. A further problem is that the angle of incidence of the electron beam to the fluorescent screen varies with the vertical scanning position of the electron beam, and the size of a beam spot in the vertical direction also changes.

In addition, it is to be noted that there occur the reflection of the electron beams and the secondary emission of electrons by the fluorescent screen 104 and the mesh-like electrodes 107 when the electron beams are incident thereon. These reflected and secondary electrons are reflected and emitted at an angle of emission, the magnitude of which is nearly equal to an angle of incidence, to the fluorescent screen 104 and the mesh-like electrodes. Further, these reflected and emitted electrons are deflected by the electric field present between the main deflecting electrode 106 and the mesh-like electrode and are incident once more on positions, which are not the same with the positions of the electron beams at the last incidence. This causes the fluorescent material 103 to unnecessarily emit light at unintended positions on the screen. Thus, the conventional device has another drawback that the contrast is reduced, and a ghost-like image is generated in the vertical direction of the screen of the display. The present invention is accomplished to eliminate the drawbacks of the conventional device.

SUMMARY OF THE INVENTION

It is therefore an object of the present invention to provide a flat panel type display having a simple structure which can increase the withstand voltage between each pair of the adjacent control electrodes and can obtain even beam spots of electrons.

Further, it is another object of the present invention to provide a flat panel type display employing a vertical-scan driving method which can prevent the re-incidence of the reflected electron beams and the secondary electrons, which are generated by the incidence of an electron beam on the electrodes, on the fluorescent screen.

To achieve the foregoing objects and in accordance with an aspect of the present invention, there is provided a flat panel type display which comprises control electrodes each divided in the horizontal direction of the screen thereof and arranged in a vacuum casing, fluorescent material provided on each control electrode, mesh-like electrodes facing the fluorescent material, vertical scanning electrodes each facing the mesh-like electrodes and divided in the vertical direction of the screen thereof and an electron source for generating a plurality of electron beams continuously or discretely in the extension of space between a light emitting portion composed of the fluorescent material and a group of the vertical scanning electrodes in the horizontal direction of the screen thereof. Further, to a first vertical scanning electrode in the side, where an electron beam going straight on is incident, is applied a voltage, of which the magnitude ($V_D$) is equal to a voltage applied to the fluorescent screen or the mesh-like electrodes. Then, to a predetermined number of the vertical scanning electrodes subsequent to the first vertical scanning electrode in the direction in which the electron beam goes straight on, is applied a voltage of which the magnitude ($V_D - V_{CC}$) is less than the voltage applied to the fluorescent screen. Thereafter, to a vertical scanning electrode subsequent to the predetermined number of the vertical scanning electrodes in the direction in which the electron beam goes straight on, is applied a voltage of which the magnitude ($V_D + V_M$) is equal to or more than the voltage applied to the fluorescent screen or the mesh-like electrodes. Thus, the vertical scanning is performed.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF PREFERRED EMBODIMENTS

Hereinafter, preferred embodiments of the present invention will be described in detail by referring to the accompanying drawings.

Figure 1A:
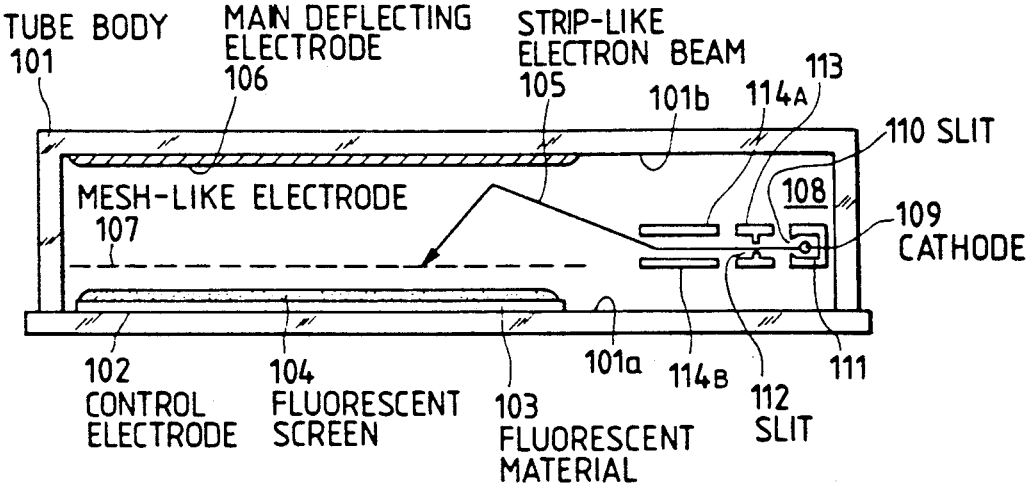
FIG. 1(A) PRIOR ART
FIGS. 1(A) and (B) are a vertical section and plan views of a conventional flat panel type display, respectively.
Figure 1B:
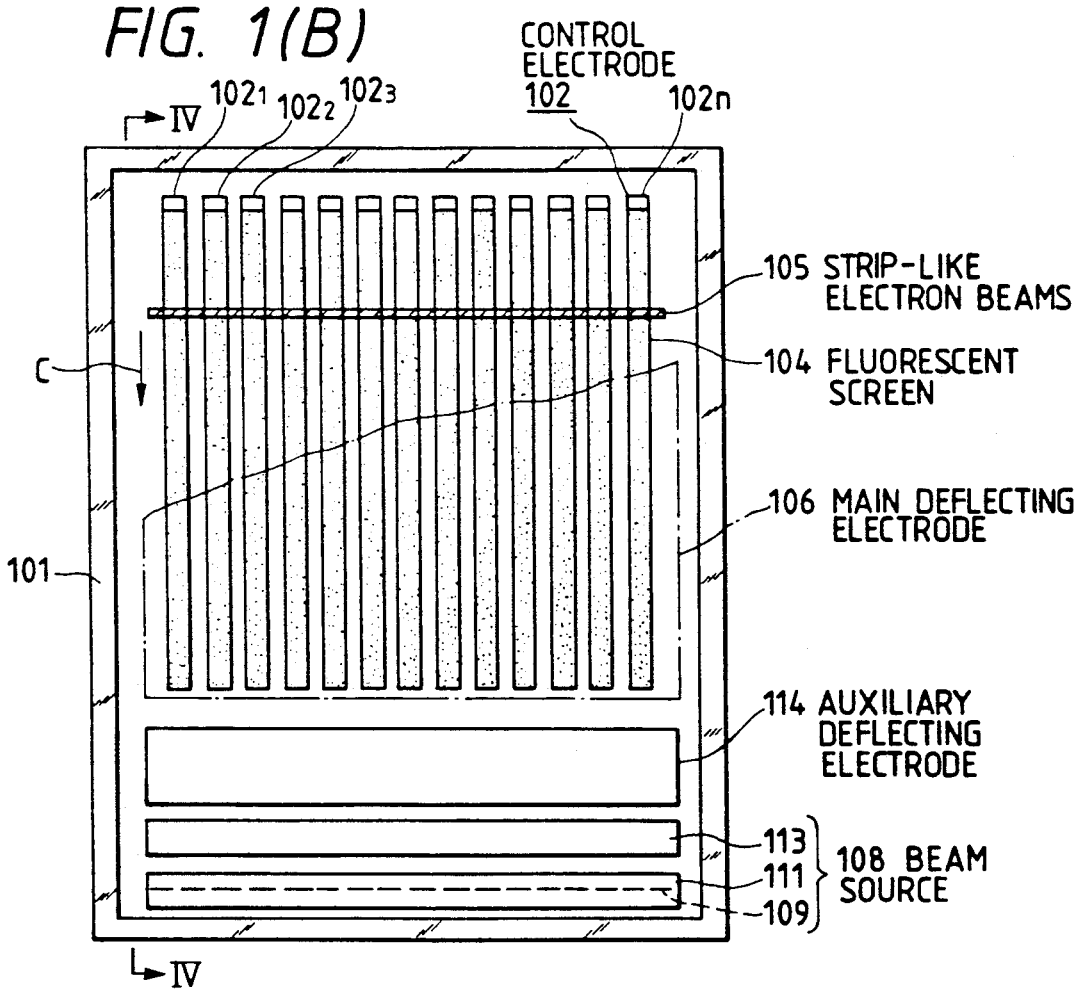
Figure 2A:
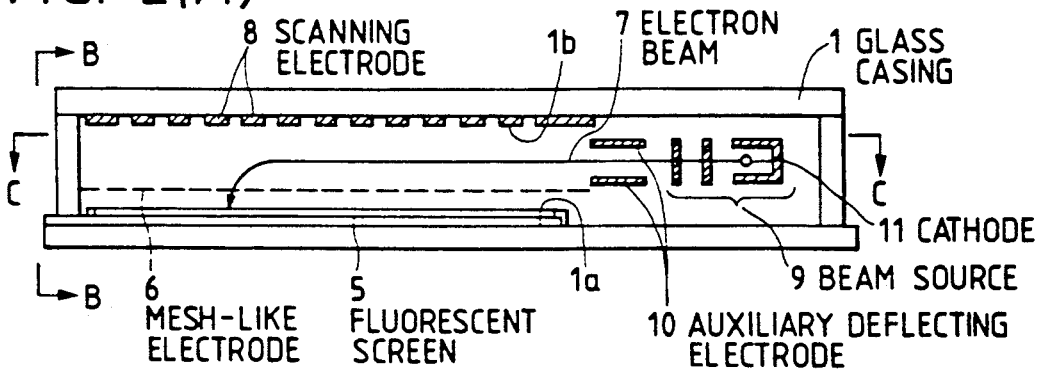
FIGS. 2(A), (B) and (C) are diagrams for showing the whole construction of a first example of a flat panel type display embodying the present invention.
Figure 2B:
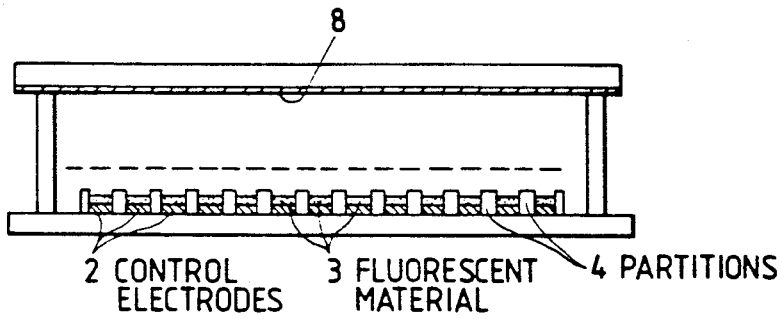
Figure 2C:
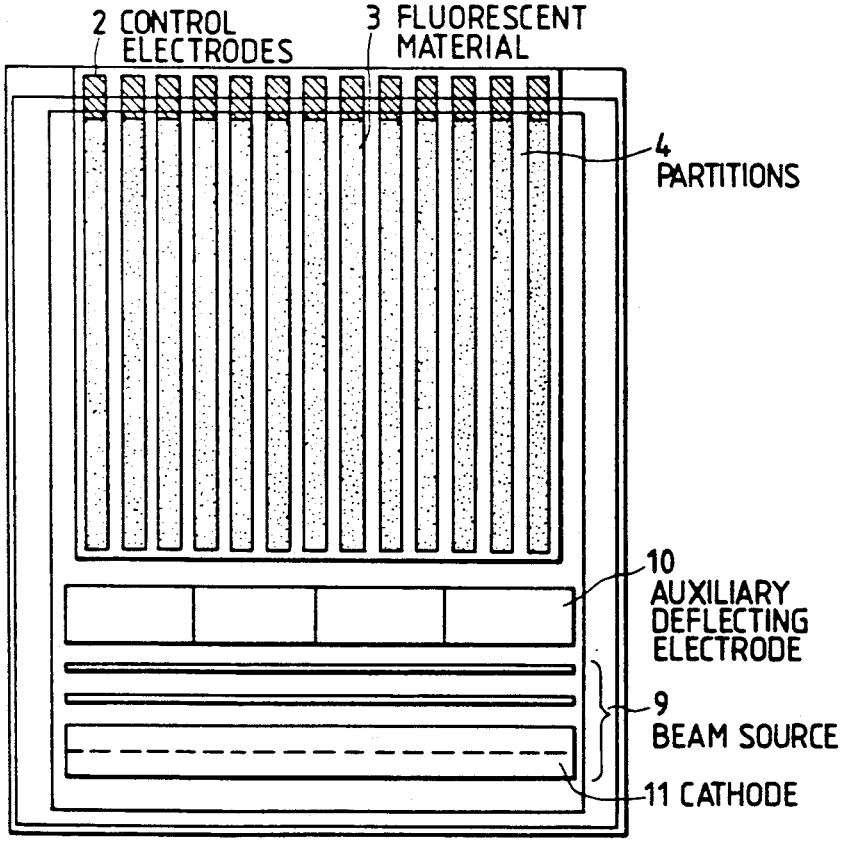
Figure 3:
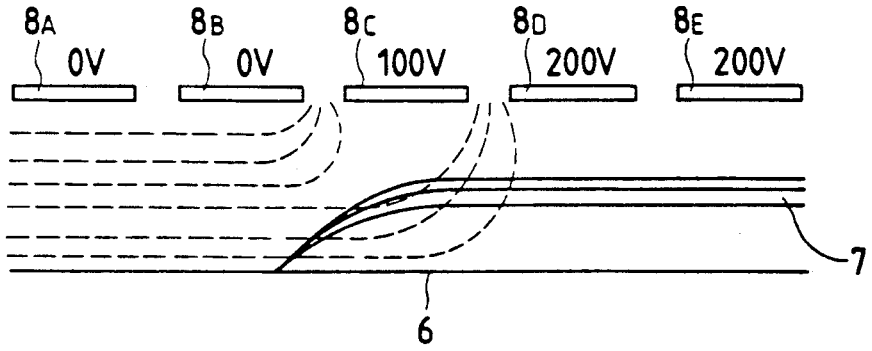
FIG. 3 is a diagram for showing the orbits of electron beams in the display of FIG. 2.

First, referring to FIGS. 2 thru 4, a first example of a flat panel type display will be explained hereinbelow. FIG. 2(A) is a side elevational view of this flat panel type display. Further, FIG. 2(B) is a plan view taken on line B—B of FIG. 2(A), and FIG. 2(C) is a front view taken on line C—C of FIG. 2(A). As shown in these figures, this flat panel type display is provided with a flat casing 1 made of glass and so forth. Furthermore, on an inner surface 1*a* of this casing 1, a plurality of stripe-like control electrodes 2, the number of which is equal to that of pixels in the horizontal direction thereof, are arranged in parallel with each other at a predetermined interval. Further, the top surface of each control electrode 2 is coated with fluorescent material 3 suitable for a low velocity electron beam. Furthermore, a fluorescent screen 5 is formed by providing partitions 4 made of insulating material such as low melting point flint glass. The thickness of the partition 4 is made larger than that of the fluorescent material 3. Over the fluorescent screen 5, is arranged a mesh-like electrode 6 facing the fluorescent screen 5 at a predetermined interval or having openings bored at the positions corresponding to the control electrodes 2. Further, on another inner surface 1*b* of the casing 1 facing the fluorescent screen 5, is provided vertical scanning electrodes 8 for deflecting a strip-like electron beam 7 to the fluorescent screen 5 and making the electron beam scan the screen 5 in the vertical direction. Each vertical scanning electrode 8 is like a strip extending in the horizontal direction and is provided on the surface 1*b* in the horizontal direction at a predetermined interval. On the other hand, at the right side of the fluorescent screen 104, as viewed in FIG. 2(A) (namely, in a bottom end in the longitudinal direction of each control electrode 2, as viewed in FIG. 2(B)), is arranged a beam source 9 for emitting a strip-like low velocity electron beam 7. The beam source 9 may be the source 108 used in the conventional device. Further, in case of this embodiment, an auxiliary deflecting electrode 10 is divided in the horizontal direction at a predetermined pitch.

Next, an operation of the conventional device as above constructed will be described hereinafter.

The beam 7 is emitted from the beam source 9 in such a manner to be in parallel with the fluorescent screen 5. However, when fabricating each electrode, it may occur that the central axis of the beam 7 at the time of being emitted by the beam source 9, the horizontal plane including the central axis of each vertical scanning electrode 8 and that including the central axis of each mesh-like electrode 6, which should be initially arranged to be in parallel with each other, are shifted from such initial relative positional relation in the horizontal direction. Thus, the voltage applied to each auxiliary deflecting electrode 10 divided in the horizontal direction is regulated such that the strip-like electron beam 7 is incident in the space between the vertical scanning electrodes 8 and the mesh-like electrodes 6 uniformly in the horizontal direction. Further, the beam 7 uniformly incident on the space between the vertical scanning electrodes 8 and the mesh-like electrodes 6 proceeds toward the fluorescent screen 5 by serially changing the voltage applied to each of the vertical scanning electrodes 8. FIG. 3 shows how the beam 7 goes toward the mesh-like electrodes 6 by regulating the voltages applied to the vertical scanning electrodes 8A-8E. First, let the ordinary electric potential of the vertical scanning electrodes 8 and the mesh-like electrodes 6 be 200 V. Then, the electric potential of the vertical scanning electrodes 8A and 8B is set as that of a cathode 11, that is, 0 V, and that of the electrode 8C is set as an intermediate value 100 V. Thus, the electron beam 7 is deflected by the electric field indicated by dashed lines in this figure toward the mesh-like electrodes 6.

Figure 4A:
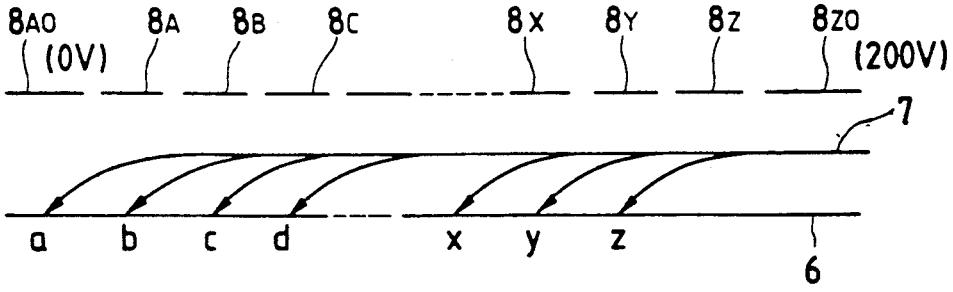
FIGS. 4(A) and (B) are waveform charts for showing the waveforms of pulse voltage signals applied to scanning electrodes in the display of FIG. 2.
Figure 4B:
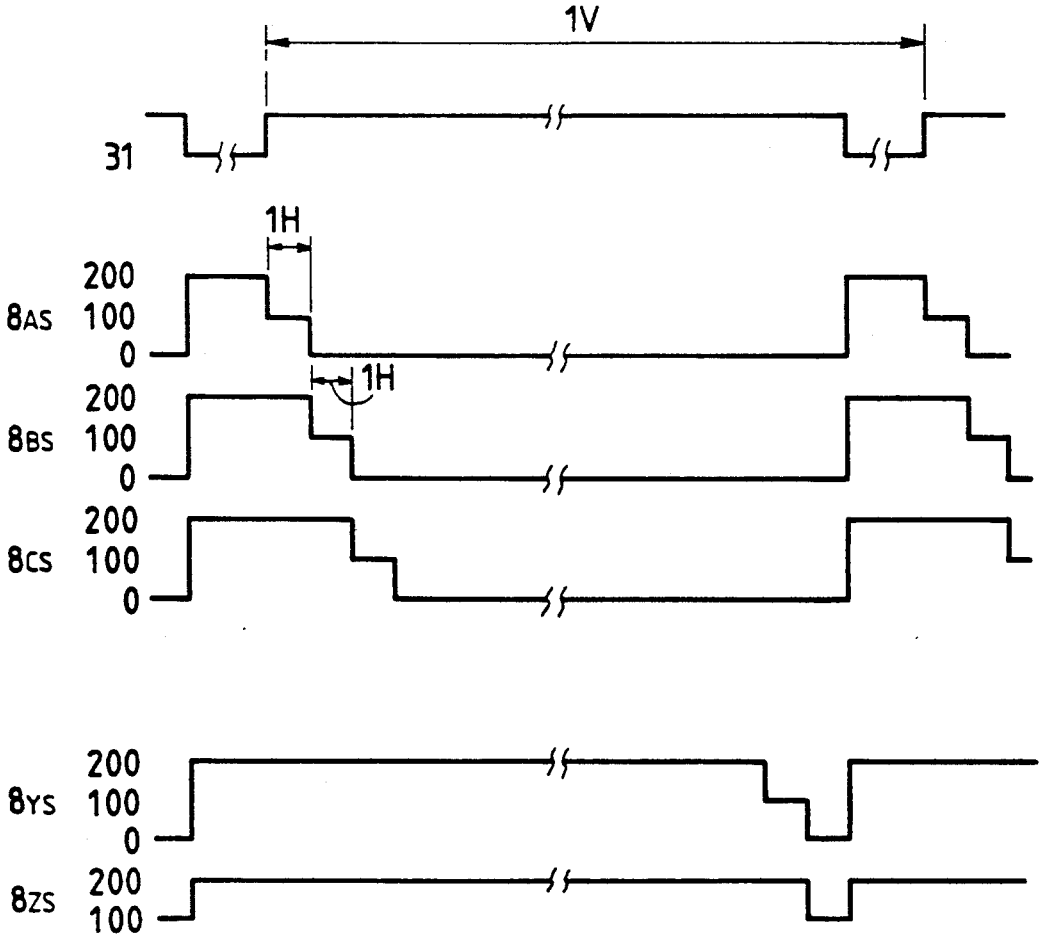

Next, it will be hereunder described how a method for performing the vertical scanning is effected by using the above described operation by referring to FIGS. 4(A) and (B). In FIG. 4(B), reference numeral 31 indicates a period, in which a picture is effectively displayed, in one field (hereunder referred to as "1 V"). Further, the waveforms of the voltage signals applied to the vertical scanning electrodes 8A-8Z are represented by reference characters 8AS-8ZS, respectively. First, when the electric potential of the vertical scanning electrode $8A_O$ is fixed to 0 V, and the potential of the electrodes 8A and 8B is set as 100 V and 200 V, respectively, the electron beam 7 is incident at a point a on the electrodes 6. Further, after a horizontal scanning period (hereunder referred to as "1 H") is elapsed, the potential of the electrodes 8A, 8B and 8C are set as 0 V, 100 V, and 200 V, respectively, and then the beam 7 is incident at a point b on the electrodes 6. By serially changing the voltage applied to each of the electrodes 8C-8Z similarly as in case of the electrodes $8A_O$-8B above described, the position of incidence, at which the beam 7 is incident, on the electrodes 6 changes from the point a to that z, thereby performing the vertical scan. Incidentally, the voltage applied to the vertical scanning electrode $8Z_O$ is constantly made equal to that applied to the mesh-like electrodes 6. In this case, it is apparent that the interval between the adjacent positions of incidence on the electrodes 6 is equal to that between the contiguous vertical scanning electrodes 8. Further, in such an operation, the angles of incidence of the beam 7 to the points a-z on the mesh-like electrodes 6 are equal to each other. Thus, are obtained the beams each having an even or constant width in the vertical direction. In order to perform an interlace scanning operation as an ordinary television system does, the voltages, which are 200 V or 100 V in case of a first field, applied to the vertical scanning electrodes 8A, 8B, . . . are set as values higher or lower than the values of the voltages applied thereto in case of the first field such that as to a second field, the electron beam is incident on points which are placed between the positions of incidence thereof in case of the first field.

Next, the electron beam 6 deflected toward the mesh-like electrodes 6 passes through the openings in the mesh-like electrodes 6 and is incident on the fluorescent screen 5. The video signal is supplied to each control electrode 2 under the screen 5, and when the fluorescent material 3 is irradiated with the beam, is obtained the emission of light, of which the intensity corresponds to the voltage of the video signal and the time of supplying thereof.

In the foregoing manner, by supplying the video signal of each "1 H" to each control electrode 2 and further effecting the vertical scanning of the strip-like electron beam 7, a desired picture is obtained. At that time, a partition 4 made of insulating material is provided between each control electrode 2 and the fluorescent material 3. Thereby, the withstand voltage between the adjacent control electrodes can be considerably increased, and a light picture can be obtained.

Next, a second embodiment of the present invention will be described hereinbelow by referring to FIGS. 5 and 6.

Figure 5A:
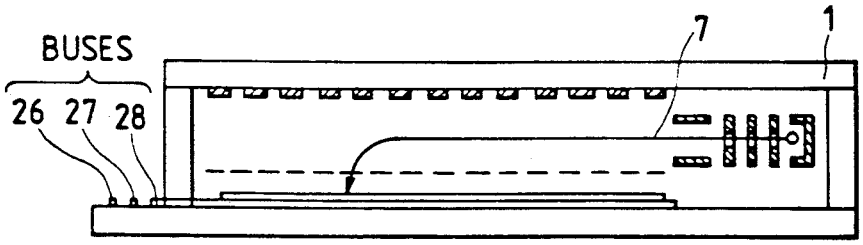
FIGS. 5(A) and (B) are diagrams for showing the whole construction of a second example of a flat panel type display embodying the present invention.
Figure 5B:
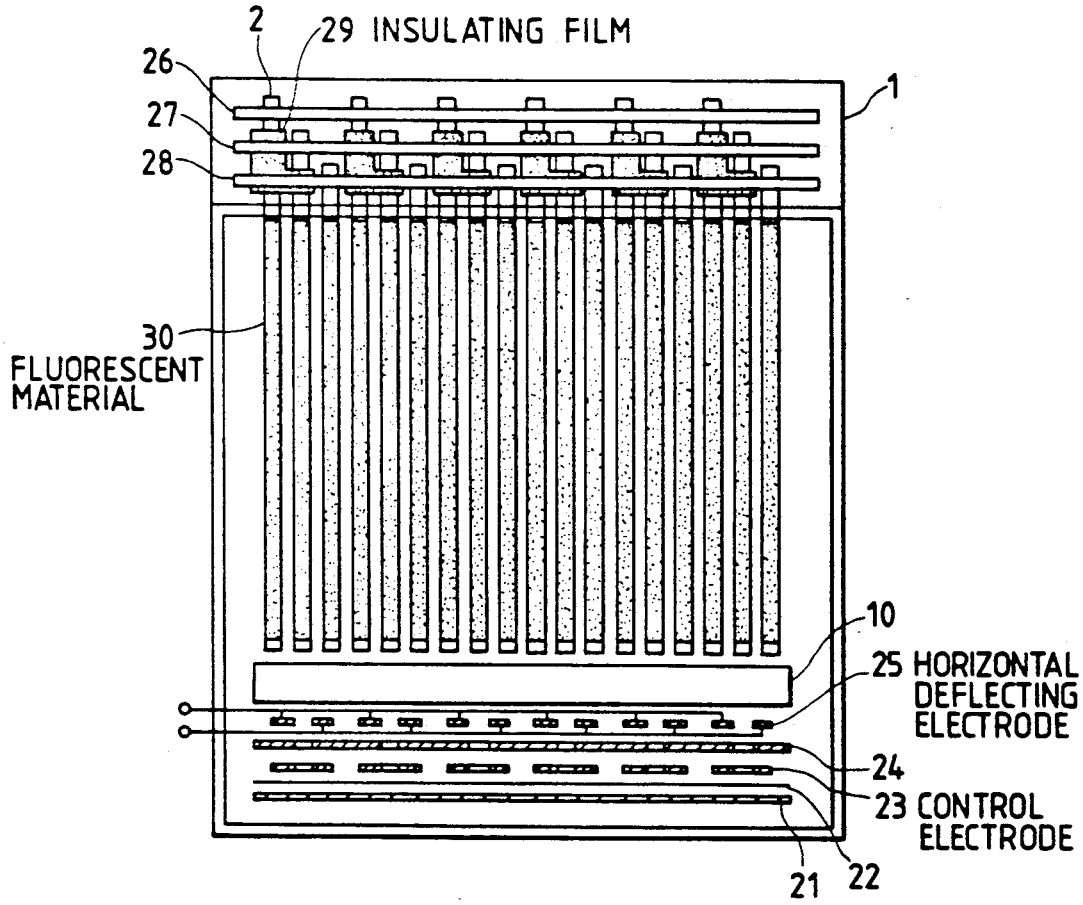

As is seen from FIG. 5 which shows the construction of the second embodiment of the present invention, the second embodiment is different from the first embodiment of FIG. 2 in that control electrodes 2 formed on an inner surface of a casing 1 are connected to buses 26, 27 and 28 every three electrodes 2, that is, the electrodes 2 are divided into three sets thereof, each set connected to a corresponding one of the buses 26, 27 and 28. In addition, the second embodiment is further different from the first embodiment in that in order to divide and emit the beam 7 to every three of the electrodes 2, openings, of which the section is circular or rectangular, are bored in other control electrodes 23 and accelerating electrodes 24 provided just prior to a cathode 22, that the accelerating electrodes 23 are divided in such a manner that each electrode 23 corresponds to every three electrodes 2 and that although back electrodes 21 and a vertical auxiliary deflecting electrode 10 are similarly provided in the first and second embodiments, in case of the second embodiment, horizontal deflecting electrodes 25 for deflecting each electron beam in the horizontal direction are provided between the vertical auxiliary deflecting electrode 23 and the accelerating electrode 24. In FIG. 5, reference numeral 29 indicates insulating films for preventing the short-circuiting of each bus and other control electrodes than the control electrodes 2 to be connected to the bus.

Next, an operation of the second embodiment will be described hereinafter.

First, the electron beam 7 generated by the cathode 22 is forced to proceed toward control electrodes 23 by the electric field applied to the back electrodes 21. Then, the beam 7, which is uniformly distributed in the horizontal direction, is divided in the horizontal direction by the electrodes 23 divided in the horizontal direction. Further, individual electron beam 7 is modulated by the corresponding control electrodes 23. The electron beam passed through the corresponding control gate 23 further passes through the accelerating electrode 24 and the horizontal deflecting electrodes 25 which are divided and arranged in such a manner to let each beam pass between a corresponding pair thereof. Subsequently, the focusing of the beam in the vertical direction and the correction of the position of the electron beam are performed by the auxiliary deflecting electrode 10. Thereafter, similarly as in case of the first embodiment, the beam proceeds the space between the scanning electrodes 8 and the control electrodes 2. Further, the electron beam is serially deflected to the side of the control electrodes 2 and causes the fluorescent material 30 provided on the control electrodes 2 to emit light.

Figure 6:
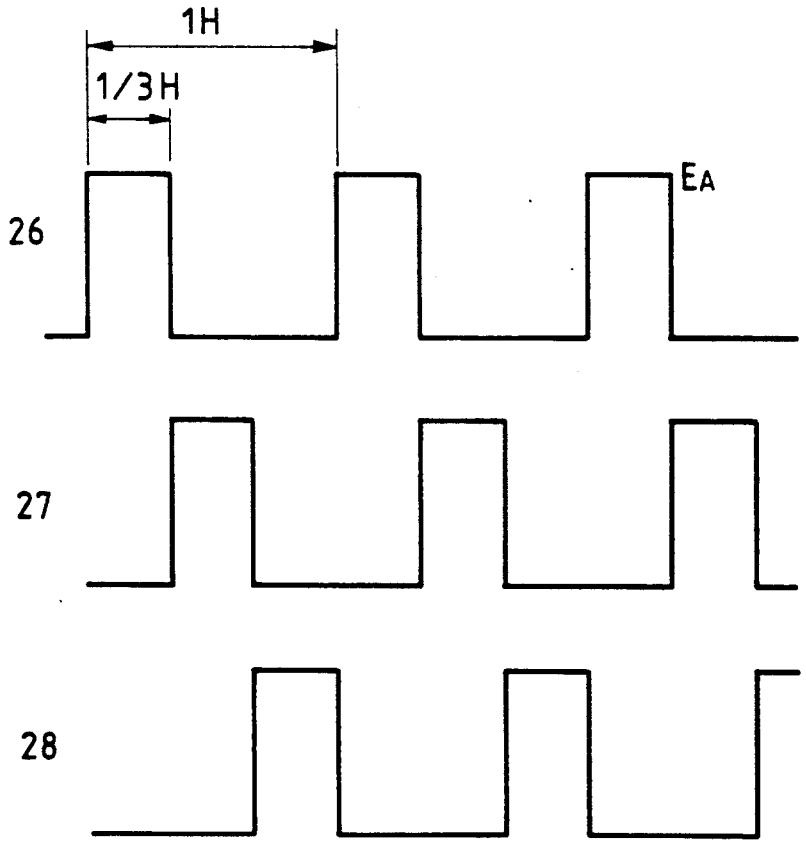
FIG. 6 is a waveform chart for showing the waveform of a pulse voltage signal applied to control electrodes.

At that time, the control electrodes 2 are divided into three groups by the buses 26, 27 and 28 as above described, and the voltage signal as shown in FIG. 6 is applied to these three groups of the control electrodes 2 through each bus 26, 27 and 28. That is, for a period of which the length is a third that of "1 H" (hereunder represented by the expression "($\frac{1}{3}$)H"), a voltage EA required for causing the fluorescent material 30 to emit light is serially applied to each bus. Here, let the fluorescent materials 30, which correspond to the control electrodes 2 connected to the buses 26, 27 and 28, correspond to, for example, R, G and B light sources, respectively. Further, for a first "($\frac{1}{3}$)H" period, the R light source emits light; for a second "($\frac{1}{3}$)H" period, the G light source; for a third "($\frac{1}{3}$)H" light source, the B light source. Naturally, an electron beam corresponding to each of light sources respectively corresponding to the set of R, G and B is generated. By modulating the respective electron beams by serially applying R, G and B signals to the control electrodes 23 in synchronization with voltage pulses applied to the R, G and B light sources, color representation of a picture can be displayed on the screen of the display. Furthermore, each electron beam is deflected by the horizontal deflecting electrodes 25 to the respective groups of the control electrodes 2 connected to the buses 26, 27 and 28. By serially deflecting the electron beams to the R, G and B light sources or fluorescent materials in synchronization with the voltage signals applied to the control electrodes 23, portions of the picture having red, green and blue colors are serially displayed on the screen.

In the second embodiment, the divisor used for dividing the electrodes 2, that is, the number of the groups of the control electrodes 2 is not necessarily 3 and may be multiples of 3. In the latter case, the adjacent electron beams are alternately generated every half of "1 H", that is, "($\frac{1}{2}$)H". Thereby, the deterioration in the horizontal resolution due to the overlap of the various electron beams resulting from the size of a horizontal spot diameter of the electron beam can be prevented. Further, the control electrodes 2 are connected to the buses 26, 27 and 28 every two electrodes 2. Moreover, as described above, the electron beam generated from the cathode is modulated by the control electrodes provided prior to the cathode. However, the same effects can be obtained by dividing the back electrodes provided in the back surface of the cathode into plural groups thereof in the horizontal direction, then applying modulation signals to the respective groups of these control electrodes and further modulating the electron beam generated from the cathode.

Next, a third embodiment of the present invention will be described hereinafter by referring to FIG. 7 to FIGS. 9(A) and (B).

Figure 7:
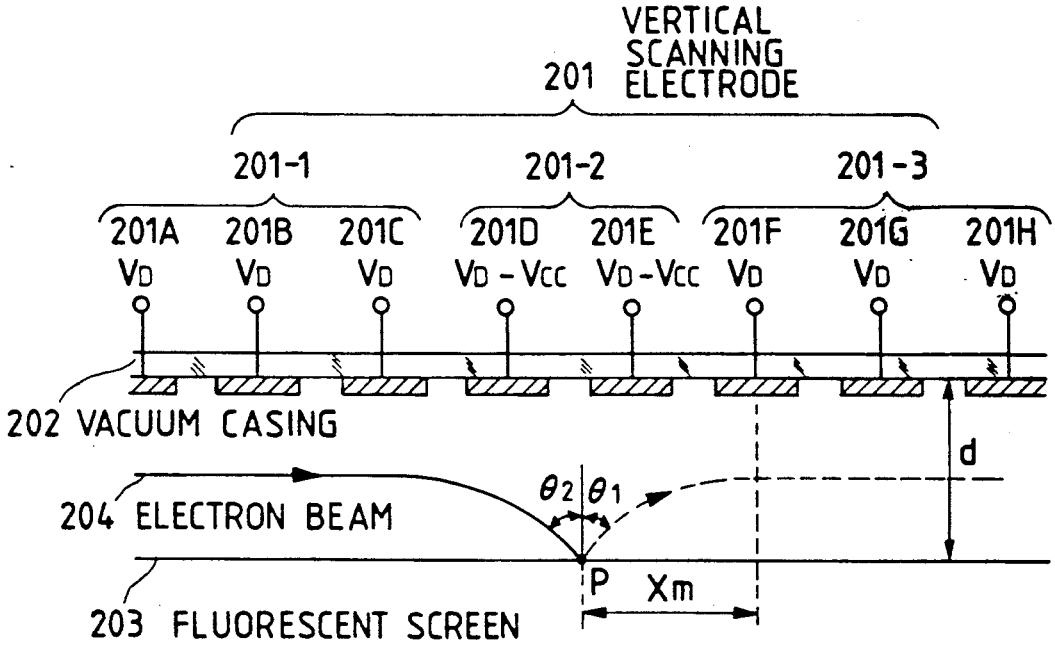
FIG. 7 is a sectional view of a third example of a flat panel type display embodiment of the present invention for illustrating the condition of applying a voltage to each vertical scanning electrode, as well as the orbits of the electron beams.
Figure 8:
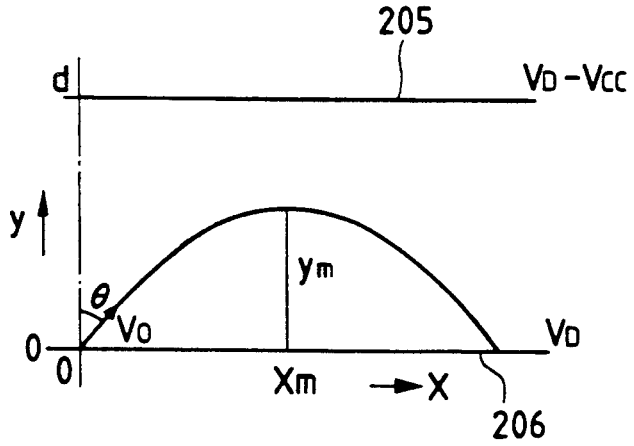
FIG. 8 is a graph for illustrating a model for obtaining the orbits of reflected electron beams of FIG. 7.
Figure 9A:
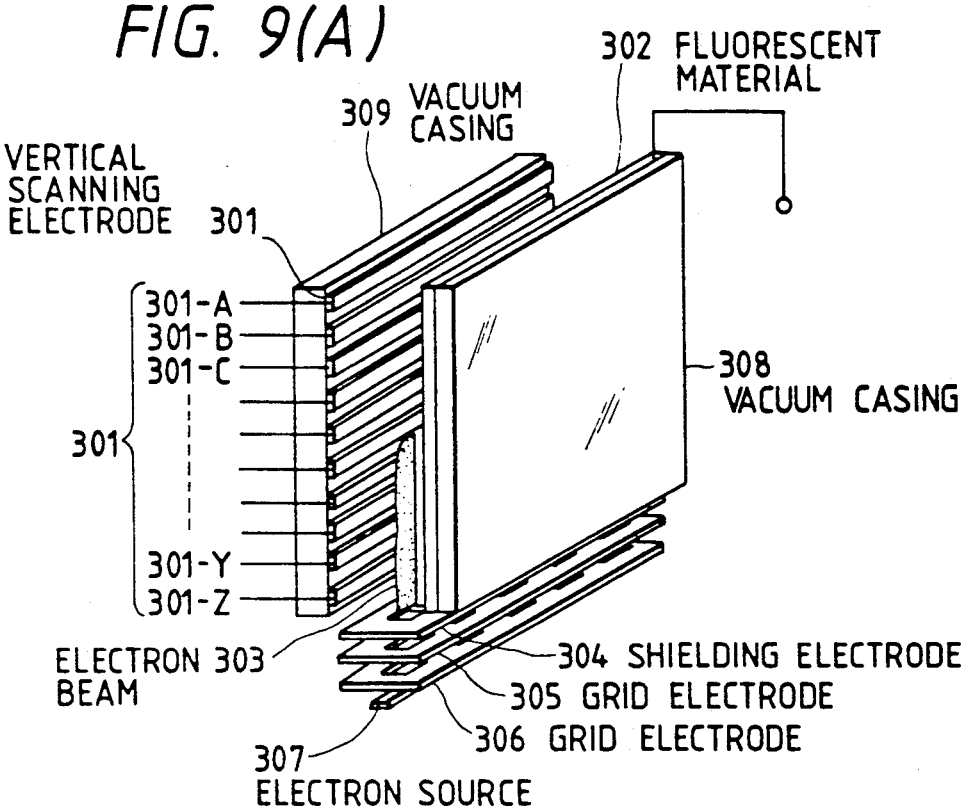
FIG. 9(A) is a perspective view of the display of FIG. 7.
Figure 9B:
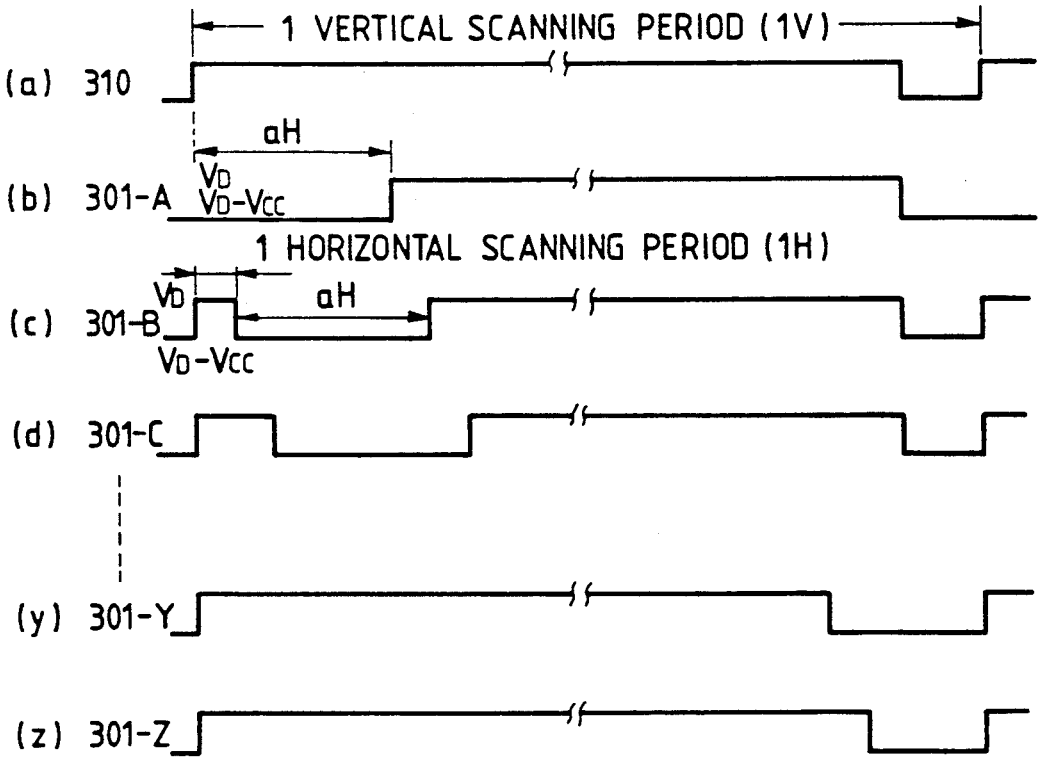
FIG. 9(B) (a)-(z) are time charts for showing the waveforms and various timing of voltage signals applied to each vertical scanning electrode.

FIG. 7 is a sectional view of the vertical scanning electrode portion for illustrating the condition of applying a voltage to each vertical scanning electrode, as well as the orbits of the electron beams. FIG. 8 is a graph for illustrating a model for obtaining the orbits of reflected electron beams of FIG. 7. Further, FIG. 9(A) is a perspective view of the display of FIG. 7 and FIG. 9(B) is time chart for showing the waveforms and various timing of voltage signals applied to each vertical scanning electrode.

Referring to FIG. 7, a voltage $V_D$, which is equal to the voltage applied to the fluorescent screen 203, is applied to a vertical scanning electrode 201-1 at the side where the electron beam 204 proceeding straight on is incident. Further, another voltage ($V_D - V_{CC}$) less than the voltage $V_D$ applied to the fluorescent screen 203 is applied to the subsequent vertical scanning electrode 201-2. Then, the electron beam 204 is subject to the deflection and focussing effected by an electrostatic lens formed between the vertical scanning electrodes 201-1 and 201-2 and is incident at a point P on the fluorescent screen 203. This position of incidence of the electron beam 204 is determined on the basis of the voltage ($V_D - V_{CC}$) applied to the vertical scanning electrode 201-2 and an interval d between each vertical scanning electrode 201 and the fluorescent screen 203. A part of the electron beam 204 incident at the point P on the fluorescent screen 203 is reflected, and in addition the magnitude of the angle $\theta_1$ of reflection of the beam 204 is nearly equal to that of the angle $\theta_2$ of incidence thereof. Moreover, an initial speed of the reflected electron is almost equal to the speed of the electron incident on the screen. The orbit of the reflected electron, in case where the voltage ($V_D - V_{CC}$) is further applied to another vertical scanning electrode 201-3, is determined by modelling it as shown in FIG. 8. The electrode 205 corresponds to the vertical scanning electrode 201, and the voltage ($V_D - V_{CC}$) is also applied thereto. Further, the electrode 206 corresponds to the fluorescent screen 203 and thus the voltage $V_D$ is applied thereto. Here, a given point on the electrode 206 is taken as an origin, and it is assumed that an electron beam is emitted from the origin at an angle $\theta$ of emission and at an initial speed $V_O$. Then, the abscissa x and the ordinate y of the electron is given by using a parameter representing time as follows.

$$x = V_O \sin\theta \cdot t$$

$$y = -(e/2m)Et^2 + v_O \cos\theta \cdot t \qquad (1)$$

$$(E = -V_{CC}/d)$$

Further, by eliminating t from the equations (1) and assuming that the initial speed $V_O$ corresponds to the voltage $V_D$, that is, $$V_o = \sqrt{(2eV_D)/m} \qquad (2)$$

where "e" denotes the electric charge of an electron and "m" denotes the mass of the electron.

Thus, an equation giving the orbit of the electron is obtained as follows.

$$y = -\{Ex^2/(4V_D \sin^2\theta)\} - (x/\tan\theta) \qquad (3)$$

From this equation, the maximum value ym of the ordinate y and the value xm of the corresponding abscissa x are obtained as follows.

$$xm = 2V_D \sin\theta \cos\theta / E$$

$$ym = V_D \cos^2\theta / E \qquad (4)$$

For example, in case where $V_D = V_{CC} = 100$ V, d = 10 mm, the initial speed of the electron beam 204 from the cathode (not shown) $V_O = 0$, the angle of incidence of the electron beam at the point P on the fluorescent screen is obtained as almost 42° (degrees). Further, in such a case, if the angle of incidence is assumed not to be 42° (degrees) but to be 45° (degrees), the values of xm and ym of the orbit of the electron are obtained as follows.

$$xm = 10\ mm,\ ym = 5\ mm$$

Provided that at least the electric potential on the vertical scanning electrodes 201-3 including and subsequent to the electrode 201F at the position of the reflected electron closest to the vertical scanning electrode 201 (that is, the position farthest from the point P) is equal to the potential $V_D$ on the fluorescent screen 203, it is understood from the foregoing consideration that the electron beam proceeds as indicated by a dashed curve shown in FIG. 7 and is never incident on the fluorescent screen 203.

Further, if the voltage $(V_D+V_M)$ higher than the voltage $V_D$ on the screen 203 is applied to the vertical scanning electrode 201-3, the re-incidence of the electron beam can be more surely prevented.

Next, FIG. 9 shows the practical timing of applying the voltage to each vertical scanning electrode 301 in case of a standard television system. In FIG. 9(B), time charts (b)-(z) are used to represent the timing of applying voltages to vertical scanning electrodes 301-A, 301-B, . . . , 301-Z, respectively.

In FIG. 9(A), an electron beam generated from an electron source 307 passes through grid electrodes 306 and 305 and a shielding electrode 304 and further proceeds through the space between vacuum casings 308 and 309. Then, as described above, the electron beam is serially deflected by the voltage applied to the vertical scanning electrodes 301 [301A-301Z] to the fluorescent material 302 so as to let the fluorescent material 302 emit light to display a picture. At that time, the voltage signal, of which the waveform is shown in FIG. 9(B), is applied to the vertical scanning electrode 301 [301A-301Z].

In FIG. 9(B), reference numeral 310 of FIG. 9(B) (a) indicates a vertical synchronization signal. First, for a period of "1 H" after the initiation of the vertical scan, the voltage $(V_D-V_{CC})$ is applied to the vertical scanning electrode 301-A. During this period, the voltage $V_D$ is applied to other vertical scanning electrodes 301-B-301-Z. Additionally, after the lapse of a period of time required for the vertical scanning of a distance at least two times the distance of xm obtained in the foregoing consideration determined on the basis of the driving condition and the distance d between the vertical scanning electrode 301 and the fluorescent screen 302, the voltage $V_D$ higher or equal to the potential on the fluorescent screen is applied to the vertical scanning electrode 301-A. By setting the period of applying the voltage $(V_D-V_{CC})$ to the electrode 301-A as the time "1 H" multiplied by an integer a (hereunder represented by the expression "aH"), the circuits can be easily designed.

After the lapse of the period "1 H", the voltage applied to the vertical scanning electrode 301-B changes from $V_D$ to $(V_D-V_{CC})$, and further after the application of the voltage $(V_D-V_{CC})$ to the vertical scanning electrode 301-B for a period of "aH", the voltage applied to the electrode 301-B is changed into $V_D$.

Since then, similarly as in case of the foregoing cases, the voltage $(V_D-V_{CC})$ lower than the potential on the fluorescent screen is maintained for a period of "aH", and further a voltage signal of which the phase is shifted by an amount corresponding to the period "1 H" is applied to each vertical scanning electrode 301, thereby performing the vertical scanning operation.

Furthermore, it is apparent to those skilled in the art that the foregoing method for driving the above described flat panel type display can be generally applied to various kinds of flat panel type displays other than those having the vertical scanning electrodes as above constructed.

As above stated, an electron beam generated from a strip-like cathode extending in the horizontal direction is serially deflected by scanning electrodes to mesh-like electrodes and a light emitting portion in which control electrodes divided in the horizontal direction at a predetermined pitch and fluorescent material are arranged. The light emitting portion is used to display a picture by applying modulation signals to the respective control electrodes, or by connecting each color light source to a common bus and then applying a sequential voltage pulse signals to each color light source and further letting the fluorescent material emit light by using modulated electron beams. The light emitting portion is divided correspondingly to kinds of colors, and then the emission of light of each color is effected by the corresponding divided portions independent from each other. Thereby, color mixture can be avoided. Furthermore, in the display of the present invention, the electron beam is generated uniformly in the horizontal direction. Alternatively, a plurality of the electron beams are simultaneously generated. Thus, the electron beam can be highly efficiently used. Therefore, a picture having high luminance can be displayed. Moreover, partitions are provided in a divided portion of control electrodes of the display according to the present invention. Thereby, the withstand voltage can be increased and thus a high voltage can be applied to the control electrodes, whereby light having high luminance can be emitted.

Incidentally, by the method for driving the display of the present invention, a ghost image due to a reflected electron beam and a secondary electron beam can be cancelled, thereby increasing picture quality.

While preferred embodiments of the present invention have been described above, it is to be understood that the present invention is not limited thereto and that other modifications will be apparent to those skilled in the art without departing from the spirit of the invention. The scope of the present invention, therefore, is to be determined solely by the appended claims.

What is claimed is:

1. A flat panel type display having a screen comprising:

a vacuum casing;

control electrodes divided in a horizontal direction of the screen in said vacuum casing;

light emitting fluorescent material formed on said control electrodes;

a mesh-like electrode provided in said casing, said mesh-like electrode being spaced from and facing said fluorescent material;

scanning electrodes each divided in a vertical direction of the screen and facing said mesh-like electrode;

an electron source provided in an extension of the space between said light emitting portion and said scanning electrodes for generating electron beams uniformly or discretely in the horizontal direction of the screen, and deflection means for deflecting said beams in said vertical direction during a vertical scanning period, said deflection means comprising signal supply means for applying first and second voltage levels to each of said scanning electrodes, said first voltage level being substantially the same as a level of voltage applied to said control or mesh-like electrode and said second voltage level being substantially less than said first voltage level, wherein said second voltage level is applied sequentially to each scanning electrode for a fixed time period, said fixed time period being at least as long as required for an electron of one of said beams reflected from a position of incidence with said fluorescent material to become substantially parallel to said scanning electrodes, each sequential application of said second voltage level to a successive scanning electrode delayed in time by a predetermined amount different from said fixed time period.

2. A flat panel type display as set forth in claim 1, wherein a partition made of insulating material is provided in each divided portion of said control electrode.

3. A flat panel type display as set forth in claim 1, wherein said electron source modulates each electron beam independently from other beams, and further including a horizontal deflecting electrode for deflecting the electron beams to a predetermined position on said light emitting portion.

4. A flat panel type display as set forth in claim 1, further including means to apply a modulation signal to each control electrode divided in the horizontal direction of the screen.

5. A flat panel type display as set forth in claim 1, wherein each group of n (which is an integer equal to or greater than 2) of said control electrodes divided in the horizontal direction of the screen are electrically connected to a common bus, to which a voltage pulse for causing each fluorescent material to emit light is applied, and phases of the voltage pulses applied to the common buses are shifted from each other.

6. A flat panel type display as set forth in claim 1, wherein said signal supply means applies said second voltage level to said scanning electrodes one after another, from said scanning electrode corresponding to the top of the screen to said scanning electrode corresponding to the bottom of the screen for serially deflecting the electron beam to the light emitting portion, at least from the top of the screen to the bottom of the screen.

7. A method for driving a flat panel type display having a light emitting portion composed of at least fluorescent material in a vacuum casing, vertical scanning electrodes each divided at a predetermined pitch and provided at a position in said casing facing said light emitting portion, a space being provided between said light emitting portion and said scanning electrodes, and an electron gun for generating linear or spot-like electron beams on an extension line drawn from said light emitting portion to said vertical scanning electrodes, said method comprising the steps of:

applying a first voltage level, equal to that applied to a light emitting portion facing said scanning electrodes, to each of said scanning electrodes for a predetermined period; and applying a second voltage level substantially less than said first voltage level, to each of said scanning electrodes, wherein said step for applying the second voltage level includes:

applying said second voltage level sequentially to each scanning electrode for a fixed time period, said fixed time period being at least as long as required for an electron of one of said beams reflected from a position of incidence with said fluorescent material to become substantially parallel to said scanning electrodes, each sequential application of said second voltage level to a successive scanning electrode delayed in time by a predetermined amount different from said fixed time period.

8. A method for driving a flat panel type display, as set forth in claim 7, which further includes the step of applying a signal, of which the voltage level is substantially equal to that applied to said light emitting portion facing said scanning electrodes, to said scanning electrodes when the electron beam is not deflected.

9. A method for driving a flat panel type display, as set forth in claim 7, which further includes the step of applying a signal, of which the voltage level is substantially equal to or higher than that applied to said light emitting portion facing said scanning electrodes, to said scanning electrodes after said first signal, of which the voltage level is less than that applied to said light emitting portion facing said scanning electrodes, is applied thereto.

* * * * *